US005301498A

United States Patent [19]

Chia et al.

[11] Patent Number: 5,301,498

[45] Date of Patent: Apr. 12, 1994

[54] ROPE CHAIN COMPONENT

[76] Inventors: Meang Chia; Cheo Chia, both of 412 W. 6th St., Suite #1104, Los Angeles, Calif. 90014

[21] Appl. No.: 899,742

[22] Filed: Jun. 17, 1992

[51] Int. Cl.[5] ..... B21L 17/00

[52] U.S. Cl. ..... 59/80; 59/82; 59/93; 59/3

[58] Field of Search ..... 59/78, 80, 82, 93, 95, 59/3

[56] References Cited

U.S. PATENT DOCUMENTS 1,631,296 3/1993 Smith ..... 59/80

OTHER PUBLICATIONS

Exhibits 1 are photographs of an item of jewelry purchased from Mervyns Dept. store in Jul. 1991.
Exhibit 2 is an advertisement for "Fancy Rope".
Exhibit 3 is an advertisement for Figarope found in the Oct. 1989 issue of Jeweler's Circular-Keystone.
Exhibit 4 is an advertisement (date unknown) depicting two chains (9th and 10th from the top) of interest.

*Primary Examiner*—David Jones
*Attorney, Agent, or Firm*—Ladas & Parry

[57] ABSTRACT

The invention is a unitary component that may be substituted intermittently for portions of a jewelry rope chain. The unitary component has connecting means that promotes the integration of the component with the conventional rope chain by receiving onto the component the individual links of the rope chain in their ordinary sequence and position as those links are sequentially and positionally comprised on a conventional rope chain. The use of the component with conventional rope chain segments results in savings of precious metal and labor costs while retaining many of the flexibility and aesthetic advantages of the conventional rope chain. The preferred embodiment of the rope chain is spiral in shape but may take on various other configurations.

42 Claims, 10 Drawing Sheets

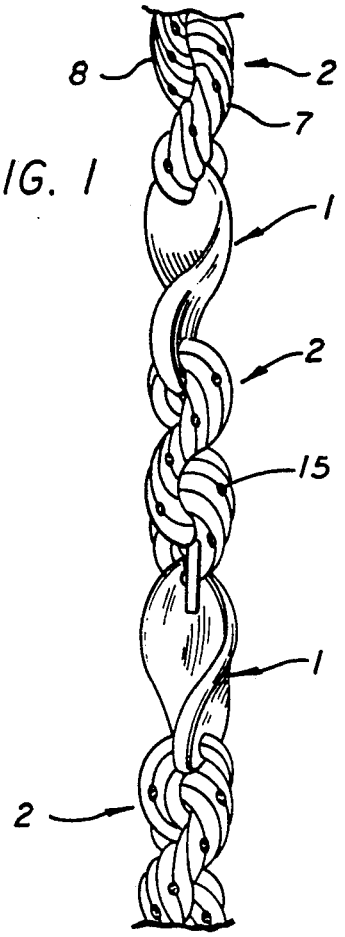
FIG. 1
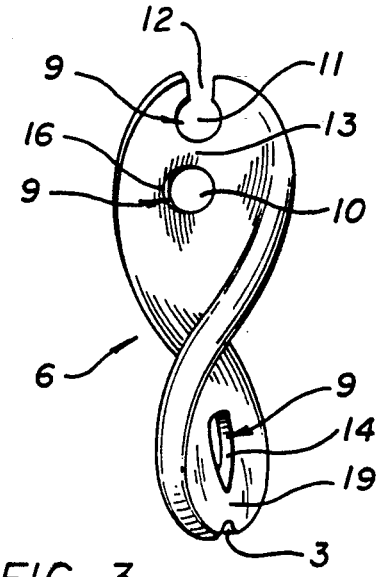
FIG. 3
FIG. 2
PRIOR ART
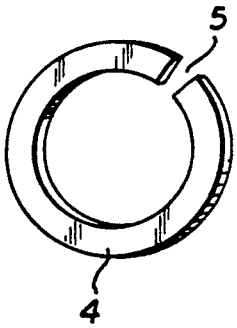
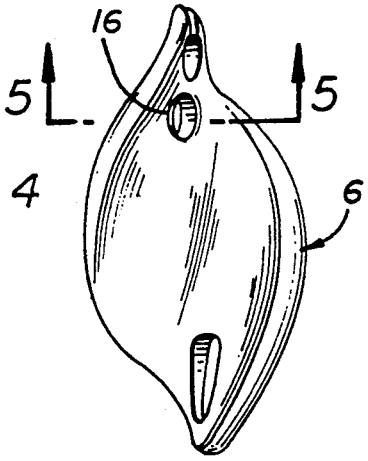
FIG. 4
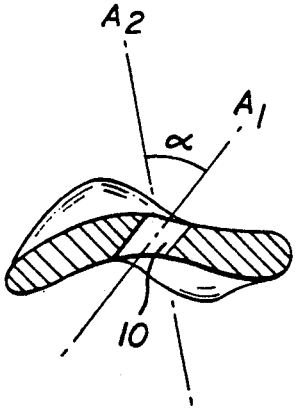
FIG. 5
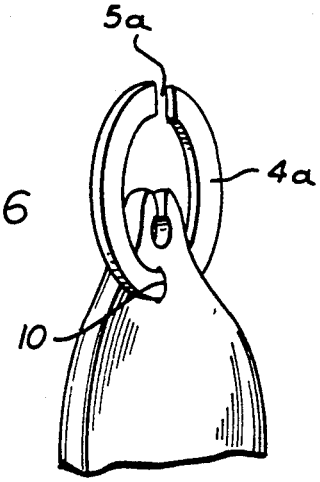
FIG. 6
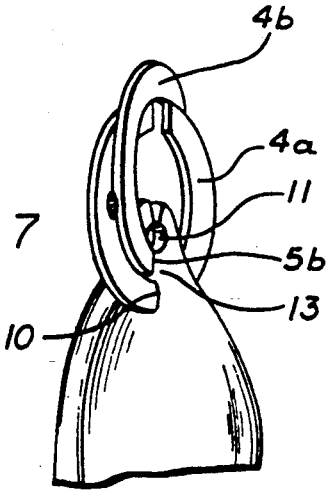
FIG. 7

FIG. 8
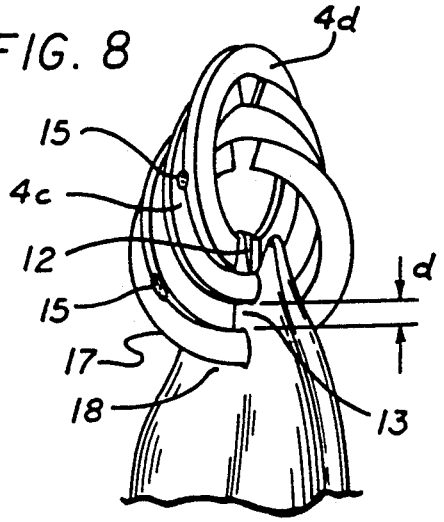
FIG. 9
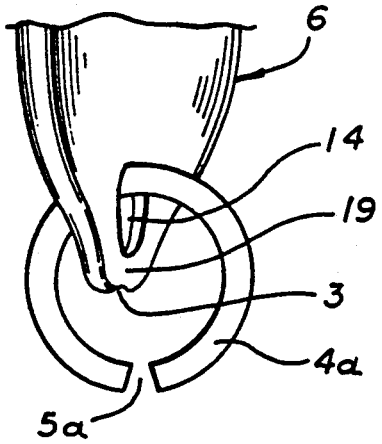
FIG. 10
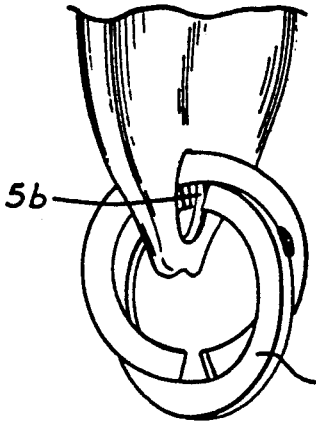
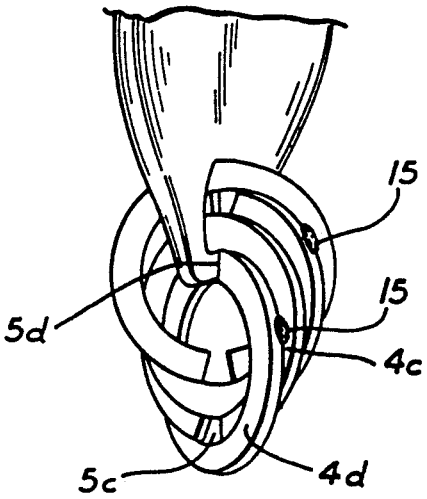
FIG. 11
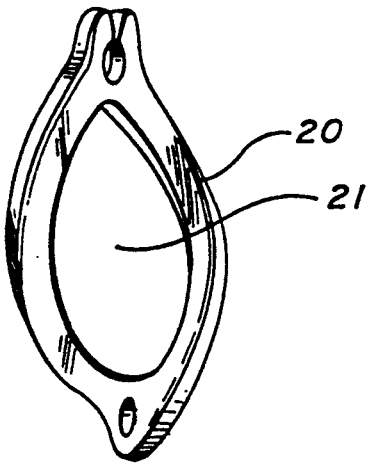
FIG. 12

FIG. 16
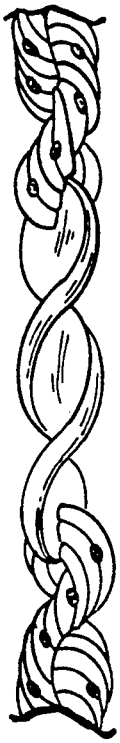
FIG. 17
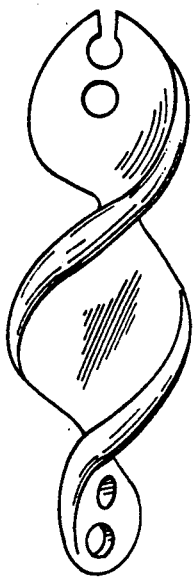
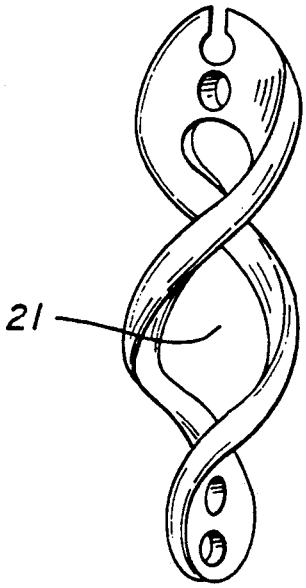
FIG. 18
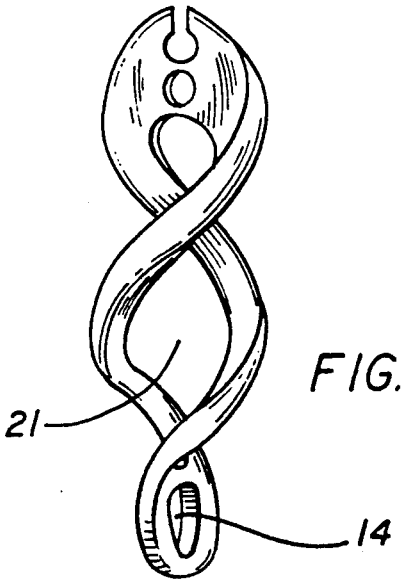
FIG. 19
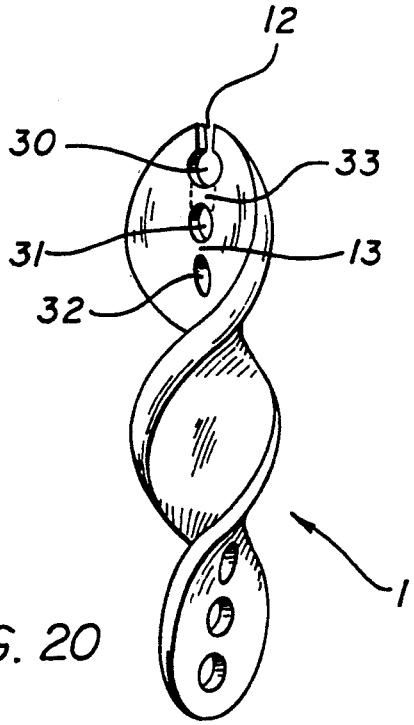
FIG. 20

FIG. 21
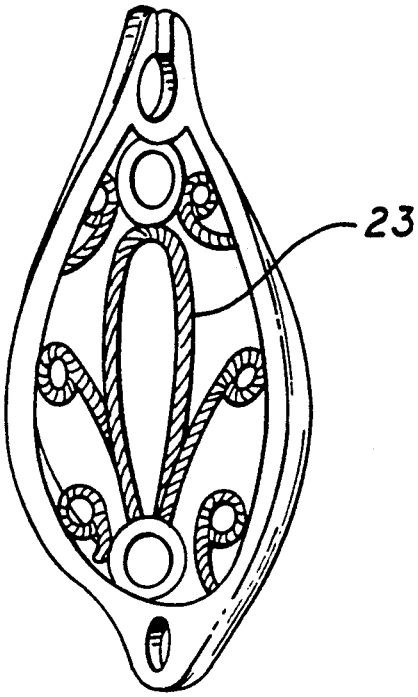
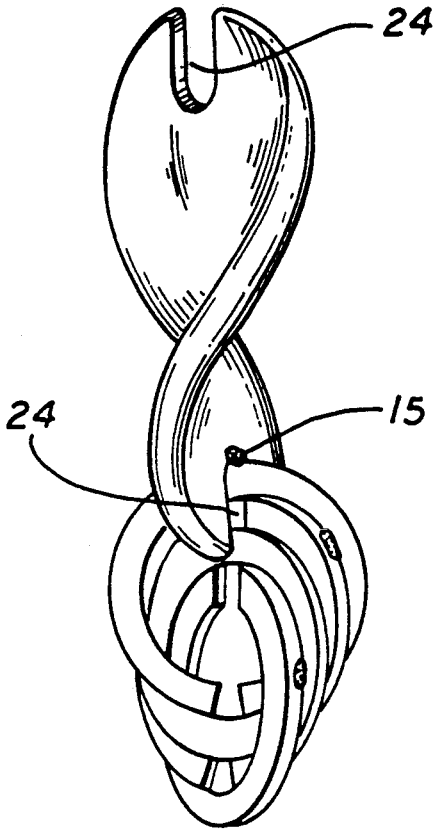
FIG. 22
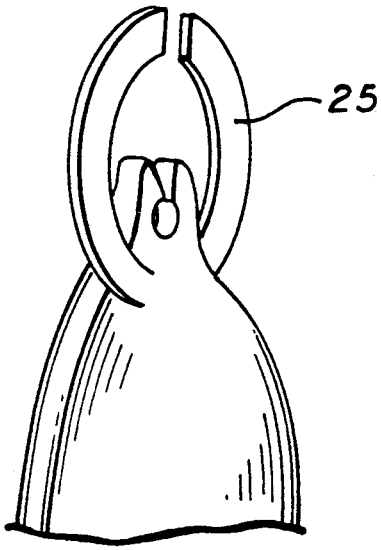
FIG. 23

FIG. 24
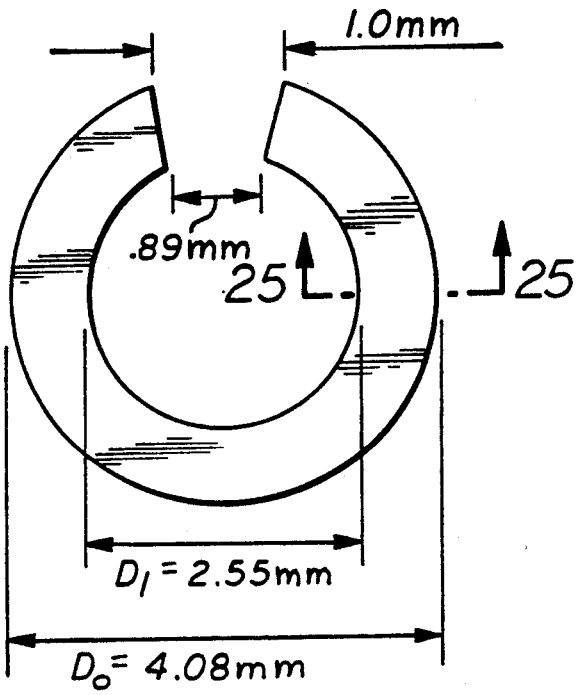
FIG. 26
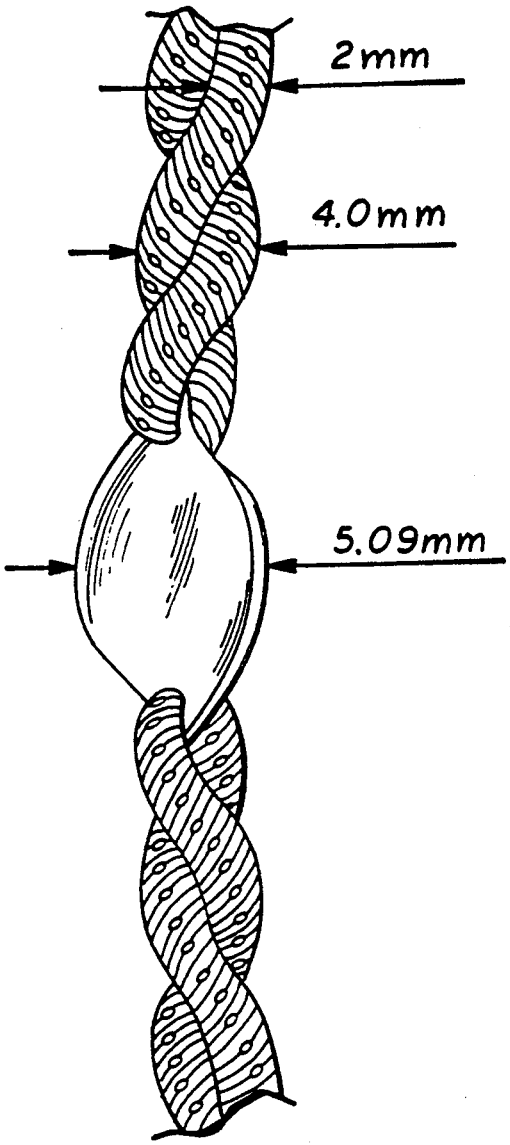
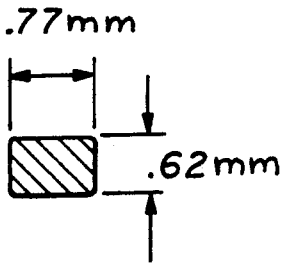
FIG. 25

FIG. 28
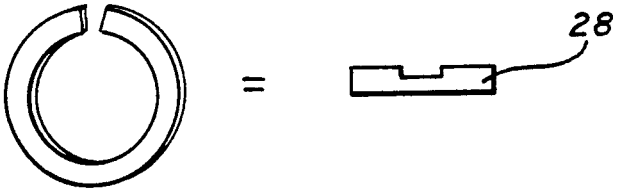
FIG. 29
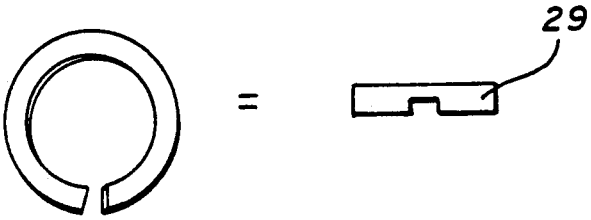
FIG. 30
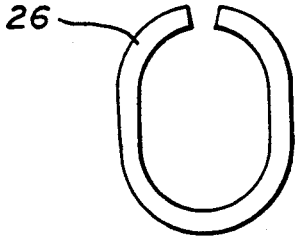
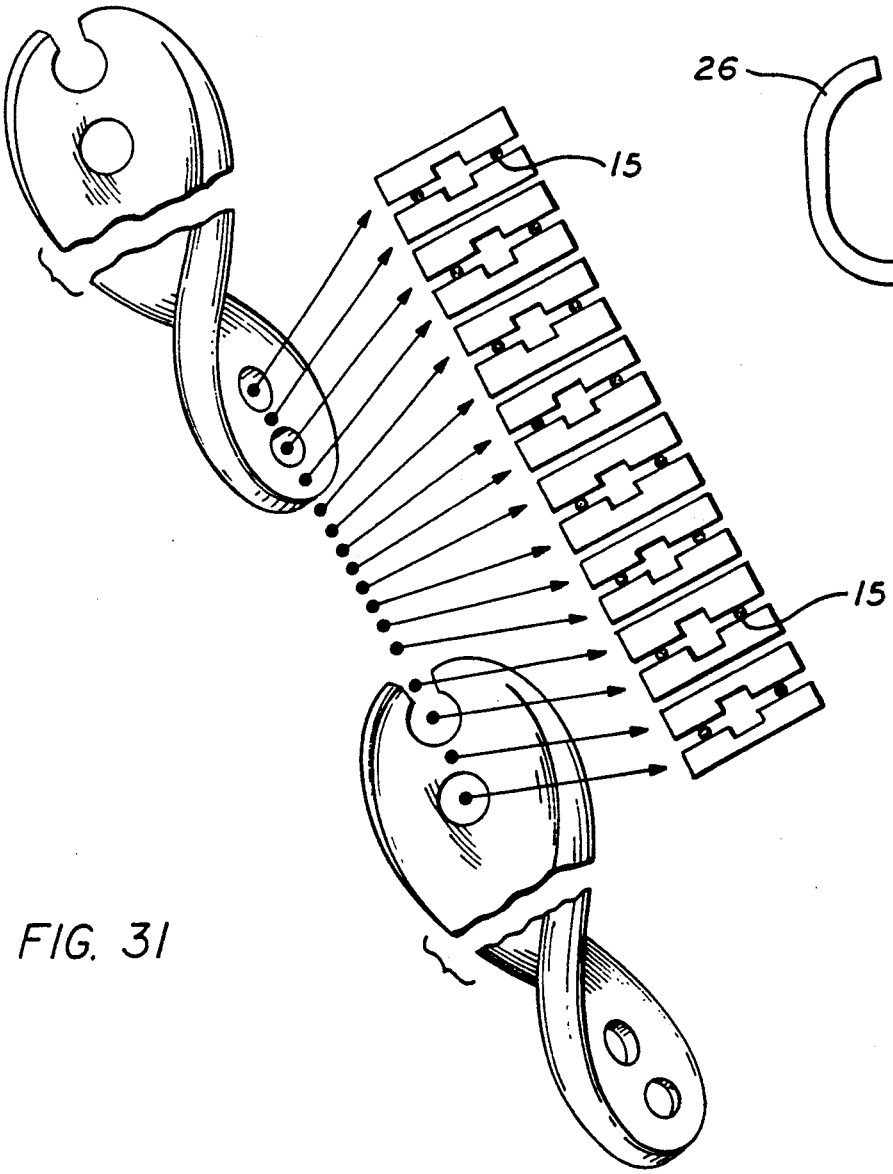
FIG. 31

FIG. 34
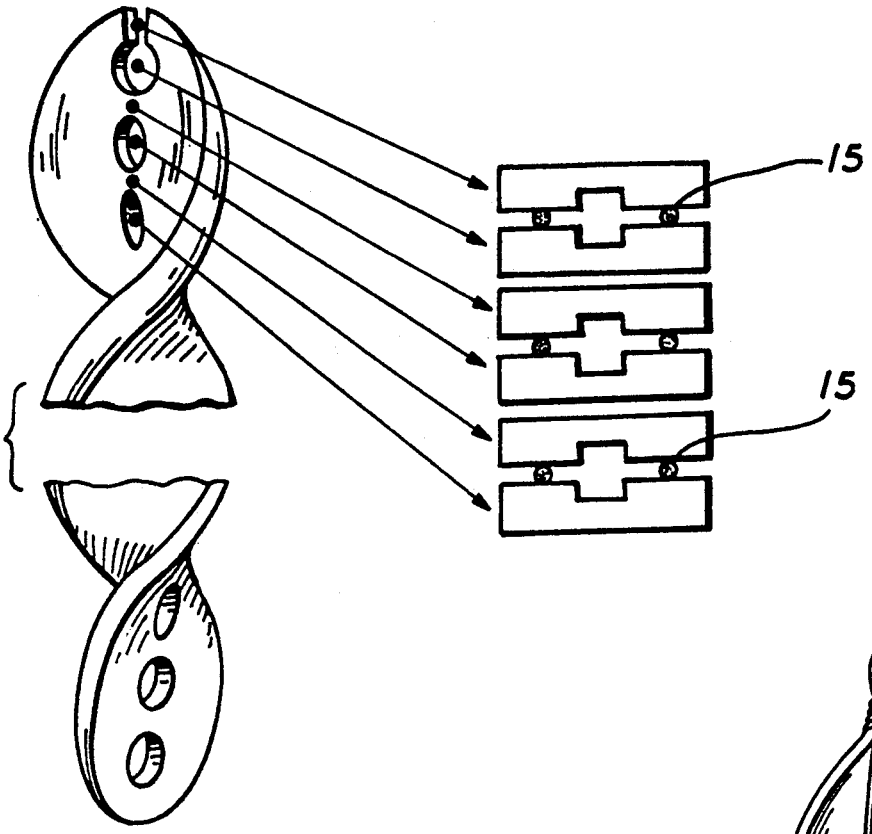
FIG. 35
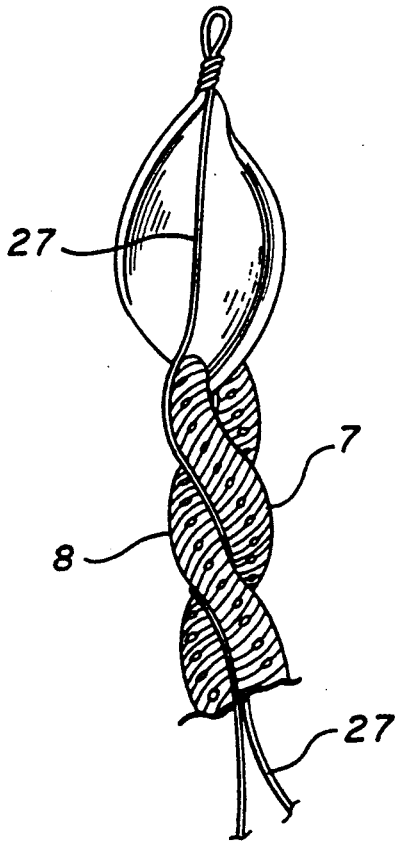
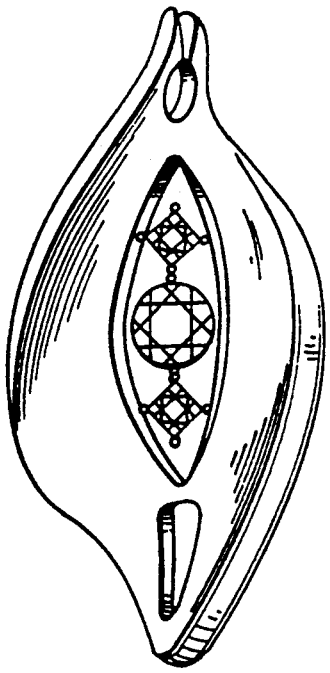
FIG. 36

ROPE CHAIN COMPONENT

FIELD OF THE INVENTION

This invention pertains to a component to be used as an element of a jewelry rope chain. More particularly, the present invention provides a unitary component having connecting means that promotes the integration of the component with the links of a conventional rope chain by receiving onto the component the individual links of the rope chain in their ordinary sequence, relative position, and orientation as is found on a conventional rope chain.

BACKGROUND OF THE INVENTION

Jewelry rope chains have been made for many years. Although rope chains can be made by machine, the better quality rope chains are usually manufactured by hand. While a rope chain has the feel of a rope, it is actually made up of a series of individual links made from a precious metal, such as gold, which links are fastened together. The links of hand-made rope chains are made with a tighter fit and are more visually appealing than are machine-made rope chains. A number of annular links are connected and intertwined together in a systematic and repetitive pattern, resulting in an eye-pleasing, flexible and delicate-appearing gold chain that looks like a fine braided spiral of connected segmented portions. In a conventional rope chain, the pattern producing the rope chain is repeated every four links and is herein referred to as the four-link rope chain. In an improvement to the conventional rope chain, it is taught in U.S. Pat. No. 4,651,517 that the links can be constructed in different and narrower dimensions so that the pattern is repeated every six links. By narrowing the cross-section of the link, the six-link rope chain's connected segments appear finer than those of the four-link version and consequently provides a more delicate and refined presentation than that previously known in the prior art of rope chains. By varying the dimensions of the annular link, even finer link arrangement can be obtained. The method of making rope chains is well-known in the art and U.S. Pat. No. 4,651,517, which discloses in detail the making of both four- and six-link rope chains, is hereby incorporated by reference herein.

The conventional four-link rope chain is costly t make. Not only is the precious metal expensive, but the manufacture of the rope chain is labor intensive. The six-link rope chain decreases the amount of precious metal necessary to manufacture a chain of a same length; however, because the links are finer, more labor is required to produce a six-link rope chain than a four-link rope chain of the same length.

SUMMARY OF THE INVENTION

The present invention is a component that is intersperedly connected to rope chain segments and substitutes for a number of links that would otherwise be part and portion of the rope chain. The component is a unitary piece that has means for interlinking with links of a length of a conventional rope chain, whether of the four-link, the six-link, a eight-link or other variety. In its preferred embodiment, the component has a configuration that substantially simulates the spiral shape of a length of rope chain. This spiral shape may be described as being similar to a double helix. Although this spiral shape constitutes a preferred embodiment, the component may take other shapes and configurations.

Because it simulates to some extent the general shape of a length of rope chain, the preferred embodiment, when mounted in a chain that also includes prior art rope chain elements, blends in with said prior art rope chain elements. The advantages of connecting the component with actual rope chain elements are several:

First, the use of the component results in a significant savings in production costs. As indicated above, higher quality rope chains ar assembled by hand. The task of interlinking hundreds of annular links to arrive at a bracelet or necklace is a long laborious process that contributes to the relatively high cost of rope chains to the consumer. By substituting the component for various segments of the chain, the number of annular links required to complete a bracelet or necklace can be reduced significantly. Correspondingly, labor costs can be reduced substantially. This results in a reduction of production costs which can translate into savings for the consumer.

Second, a given length of the component is lighter and has less mass than a section of rope chain of the same length. Therefore, the amount of precious metal required to manufacture a necklace or bracelet with the component integrated therein will be less than in the conventional rope chain. By weight, the spiral component weighs 12–15% less than a rope chain segment of the same length. A filigreed version of the component weighs 18–22% less than a rope chain segment of the same length. The result is a reduction in the cost of materials, which may be quite substantial where the material used is gold.

Third, the combination of the component with the conventional rope chain expands the horizons for the creative jewelry designer. The component, while in its preferred embodiment simulating the continuation of the double-helix configuration through the length of the chain, also presents such a designer with opportunities for creating new and different ornamental designs. The component can be a helicoid spiral (as in FIG. 3), an actual double helix (as in FIG. 12), or contain filigreed detail elements (as in FIG. 21). The component can also be of different shapes or colors or a diamond may be set thereon. In fact the component may incorporate any setting, a diamond cut design or any number of other designs. Each one of these, while perpetuating consistency of lines and common design throughout the chain, creates it own distinctive artistic impression.

Fourth, the component, in achieving its cost savings and artistic objectives, does so with minimal compromise to the rope chain's inherent attributes. These attributes are an interesting and delicate design and flexibility. The interesting and delicate design is retained because the component, in its preferred use, is connected with conventional rope chain elements in such a way that the individual links of the rope chain are received on the component in their ordinary sequence and position as occurring on a conventional rope chain. The component itself, as indicated above, integrates in with these actual conventional rope chain elements. Meanwhile, with its conventional rope chain elements, the chain will retain its flexibility.

BRIEF DESCRIPTION OF THE DRAWINGS

In describing the invention, reference will be made to the accompanying drawings wherein:

FIG. 1 is a view of the invention in a position of use wherein it is connected to segments of a conventional rope chain.

FIG. 2 is a view of an annular link of the prior art, a plurality of which are connected and intertwined together to form the conventional rope chain.

FIG. 3 is a front view of the one-half turn spiral component embodiment of the present invention.

FIG. 4 is a view of the one-half turn spiral component from a 90 degree angular displacement to the left.

FIGS. 5 is a cross-sectional view through line 5—5 of FIG. 4.

FIGS. 6–8 illustrate the sequential coupling of annular links with the spiral component's two-hole connection means illustrated in FIG. 3 and with each other during a first repetition of the construction of the conventional four-link rope chain.

FIGS. 9–11 illustrates the sequential coupling of annular links with the spiral component wherein the connecting means is an elongated aperture.

FIG. 12 depicts a second embodiment of the invention, a one-half turn unfilled double helix.

FIG. 16 illustrates a third embodiment of the invention in a position of use, said third embodiment comprised of a full turn filled double helix.

FIG. 17 depicts the full turn filled double helix spiral component without the rope chain portions connected thereto.

FIG. 18 depicts a fourth embodiment of the invention, a full turn unfilled double helix.

FIG. 19 shows the full turn unfilled double helix wherein one of the connection means is an elongated aperture.

FIG. 20 depicts the full turn filled double helix adapted for a six-link configuration rope chain.

FIG. 21 depicts a fifth embodiment of the invention, a filigreed version of the component.

FIG. 22 depicts connection means comprised of an open elongated aperture. The first link is soldered to the component.

FIG. 23 depicts a sixth embodiment of the invention wherein annular link members are integrally provided on each end of the component.

FIG. 24 depicts the conventional annular link with its relevant approximate dimensions.

FIG. 25 is a cross-sectional view of line 24—24 of FIG. 23.

FIG. 26 depicts the preferred embodiment of the invention in a position of use with relevant approximate dimensions.

FIG. 28 depicts an annular link and its schematic equivalent where the gap is in a upward orientation.

FIG. 29 depicts an annular link and its schematic equivalent where the gap is in an orientation that is opposite that depicted in FIG. 28.

FIG. 30 depicts an elongated link that is adapted for three, four and five hole connection means on components.

FIG. 31 is an illustrative schematic representation of the annular links as they are orientated with respect to the component and to each other in the practice of this invention in the four-link repetition variety.

FIG. 34 is an illustrative schematic representation of the annular links as they are oriented with respect to a "filled" component and to each other in the practice of this invention in the six-link repetition variety.

FIG. 35 illustrates the use of a wire to keep annular links in place until solder can be applied.

FIG. 36 illustrates an embodiment of the invention wherein the body has a precious stone set thereon.

DETAILED DESCRIPTION

Figure 13:
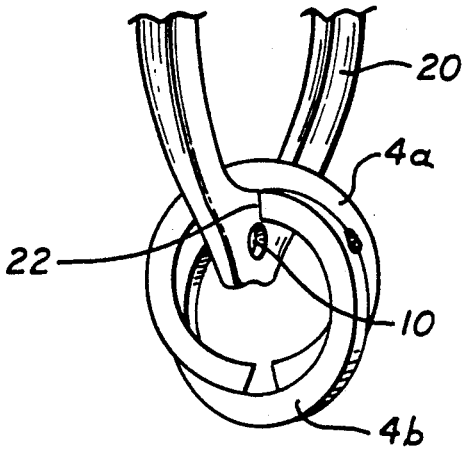
FIGS. 13 and 14 illustrate the sequential coupling of annular links with the one-half turn unfilled double helix of FIG. 12.

Referring now to the drawings, there is illustrated in FIG. 1 a view of the preferred embodiment of the rope chain component 1 in a position of use, connected with conventional rope chain segments 2. The conventional rope chain segments 2 pictured here are of the four-link repetitive variety. The component can be modified to adapt to the six-link type or eight-link type as well as other variations. The conventional rope chain segments 2 are made with a systematic and repetitive interlinking of basic annular link 4 that has a gap 5 therein. The annular link 4 must meet certain dimensional requirements for the interlinking to result in a well-fitting rope chain. Such dimensions are known in the art and will vary from four-link variety to six-link variety to eight-link variety. The annular link 4 and the gap 5 thereon is depicted in FIG. 2.

FIG. 3 illustrates an embodiment 6 of the component 1 that substitutes for a length of rope chain that represents a one-half or 180 degree revolution of a "filled" double helix. This embodiment 6 is hereinafter referred to as the "one-half turn spiral component". It should be noted here that the conventional rope chain is not truly composed of a double helix but merely provides the appearance of a double helix. As can best be viewed in FIG. 1, the inter-twined links in the conventional rope chain segment 2 produces the appearance of a first braid 7 and a second braid 8, the combination of which results in a double heloidical appearance.

FIG. 4 is a view of the one-half turn spiral component 6 from a 90 degree angular displacement to the left, compared to FIG. 3.

Returning to FIG. 3, the one-half turn spiral component 6 . is helicoid in shape with its opposite edges spiraling in opposition and providing the appearance of a double helix. The term "filled" is used because a true double helix is comprised of two helicoid lines encircling each other. Here, the component gives the appearance of a double helix but the space between the two helicoid lines is filled. The one-half turn spiral component 6 also has means for connection 9 with conventional rope chain segments. In this particular case, on one end of component 6, such connection means 9 are comprised of aperture 10 and open-aperture 11. Open aperture 11 has an opening 12 and the space between aperture 10 and open aperture 11 comprises a nexus 13.

On the other end of component 6, connection means 9 are comprised of an elongated aperture 14 and a notch 3. Each of the apertures may have a scalloped portion 16 which permits an associated annular link 4 to rest in a determined position.

As will be seen, these connection means 9 can be varied in their arrangement and this particular combination is described herein for illustrative purposes only. In general terms however, the connection means 9 permit the receiving of a plurality of annular links 4 of a rope chain to be received onto and connected to the rope chain component 1 in their ordinary sequence and position as they occur on a rope chain segment. In a conventional rope chain, an annular link located on the chain has substantially the same general orientation as the seventeenth annular link further down the chain. In approximate terms, each link on the chain has an angular displacement of 22.5 degrees when compared with the links immediately adjacent thereto, i.e. 360°/16 links=22.5 degree per link. The connection means 9 takes this angular differential into consideration so that each link may be received onto the component 1 in their mutual and ordinary orientation on the rope chain.

As an illustration, reference is made to FIG. 5 which is a cross-sectional view through line 5—5 of FIG. 4. The axis $A_1$ through aperture 10 is at an approximate angle $\alpha$ of 45° from the axis $A_2$ of open aperture 11. This permits, as will be seen, the respective annular links through aperture 10 and open aperture 11 to be properly positioned with respect to each other and with respect to the annular link that resides between those two. Alternatively, the apertures may be given a large enough diameter to permit the annular links within to rest in a broader range of angles. This is less preferred as the annular links would be in a less fitting relationship with the component.

FIGS. 6–8 illustrates the manner of coupling an end of the one-half turn spiral component 6 of FIG. 3 to a conventional four-link rope chain segment 2. As portrayed in FIG. 6, a first annular link 4*a* is inserted into aperture 10. Gap 5*a* of first annular link 4*a* is placed substantially opposite the portion of the link that lies in aperture 10. Described in different terms, the gap 5*a* is about 180 degrees displaced from that portion of the link that lies within aperture 10.

A second link 4*b* is then added as shown in FIG. 7. Second annular link 4*b* is inter-linked with annular link 4*a* by inserting, via gap 5*b*, second annular link 4*b* over first annular link 4*a*. Gap 5*b* rests over nexus 13, that portion of the component 6 that lies between aperture 10 and open aperture 11. The distance between aperture 10 and open aperture 11 (signified by "d"), otherwise known as the width of nexus 13, should provide enough room for second annular link 4*b* to rest.

FIG. 8 shows the affixation of the third annular link 4*c* and fourth annular link 4*d* to complete the first repetition. Third annular link 4*c* is inserted through first annular link 4*a*, second annular link 4*b* and through open aperture 11 via gap 5*c*. Third annular link 4*c* is then circumferentially rotated until gap 5*c* lies opposite that portion of third annular link 4*c* that sits within open aperture 11. Fourth annular link 4*d* is then inserted over annular links 4*a*–4*c* via gap 5*d* and gap 5*d* is brought to confront opening 12. This completes the first repetition.

As taught in the prior art, first annular link 4*a* is attached to second annular link 4*b* by solder 15, best viewed in FIG. 8. Third annular link 4*c* is attached to fourth annular link 4*d* in like manner. The bonding between each of these two pairs of annular links insures that the rope chain will not unravel into its constituent elements. At the same time, the first and second annular links, 4*a* and 4*b*, are not bonded to the third and fourth annular links, 4*c* and 4*d*. It is this relative freedom of movement between each of these linked pairs that provides the rope chain with its flexibility.

For purposes of clearly illustrating the intertwining of the annular links, 4*a*–4*d*, with the spiral component 6 and each other, the links are not necessarily rendered in FIGS. 6–8 in their actual orientation. For example, in FIG. 1, first annular link 4*a* appears as if its circumference is normal to the surface of spiral component 6. In actuality, as illustrated in FIG. 8, first annular link 4*a* is rotated so that its surface 17 (hidden from view by its opposite side) is brought into close proximity to the surface 18 of spiral component 6 and into the space created by scallop 16. Scallop 16, hidden from view by first annular link 4*a* in FIG. 8, provides the associated annular link 4 with room for movement and a position of rest and therefore adds to the flexibility of the chain. Each subsequent added annular link 4 is similarly rotated. FIG. 1 provides a more accurate rendition of the layering of the various annular links 4.

After completion of the first repetition, a second repetition is started by inserting a fifth annular link over annular links 4*b*–4*d*. The fifth annular link is threaded between . gap 5*a* of first annular link 4*a*. This fifth annular link is then circumferentially rotated until its gap lies substantially opposite that portion of link located within gap 5*a*. The second, third and fourth links of this second repetition are then added as described above in the case of the first repetition. The continued extension of the rope chain by adding annular links 4 is conventionally known as described in U.S. Pat. No. 4,651,517. This process continues until the desired length is obtained for the conventional rope chain segment.

As the rope chain is made longer and longer with the addition of annular links 4, the opportunity for unraveling of the annular links 4 increases. To continuously apply solder to every two annular links 4 as those two links are added would be interruptive of the interlinking process and be cost-ineffective. One manner of maintaining the rope chain and preventing the unraveling until a more feasible time when solder 15 could be applied, is to wind a wire 27 over one end of a rope chain (or component), double up the wire and wrap it along both opposite sides of the rope chain between braids 7 and 8 as the rope chain is extended by the addition of annular links 4. This is illustrated in FIG. 35. The buttressing effect of the wire will hold the annular links 4 in place until solder can later be added.

It should be restated that the above description is in the context of a four-link rope chain. By modifying the connection means, the spiral component 1 can be adapted to couple with a six-link rope chain or another variation thereof.

FIGS. 9–11 depict the coupling of conventional rope chain annular links 4 with the other end of the one-half turn spiral component 9 depicted in FIG. 3. As can be seen, connection means 9 on this end of component 9 differs from the previously described connection means 9. Here, the connection means 9 is comprised of an elongated aperture 14. A notch 3 may be disposed at the end of the component 6 to provide freedom of movement for an adjacent annular link 4. The notch 3 may or may not be necessary depending on the width of lobe 19.

As portrayed in FIG. 9, a first annular link 4*a* is inserted into elongated aperture 14. First annular link 4*a* is placed so that it abuts to that portion of the aperture that is closest to the center of the component 6 and furthest from notch 3. Gap 5*a* of first annular link 4*a* is placed substantially opposite the portion of the link that lies in elongated aperture 14.

FIG. 10 shows the addition of a second annular link 4*b*. Second annular link 4*b* is inter-linked with annular link 4*a* by inserting, via gap 5*b*, second annular link 4*b* over first annular link 4*a*. Gap 5*b* preferably, but not necessarily, may rest within. elongated aperture 14. Elongated aperture 14 should have a length so that three annular links 4, in their ordinary and relative positions on the rope chain, may fit therewithin.

FIG. 11 shows the affixation of the third annular link 4*c* and fourth annular link 4*d* to complete the first repetition of the rope chain on this end of the 4-link rope chain. Third annular link 4*c* is inserted through first annular link 4*a*, second annular link 4*b* and through open aperture 11 via gap 5*c*. Third annular link 4*c* is then circumferentially rotated until gap 5*c* lies opposite that portion of third annular link 4*c* that sits within elongated aperture 14. Fourth annular link 4*d* is then inserted over annular links 4*a*–4*c* via gap 5*d* and gap 5*d* is brought to abut to lobe 19. Lobe 19, that portion between the elongated aperture and the end of component 6 is approximately the length of the cross-sectional width of annular link 4. This completes the one repetition.

As taught in the prior art and described above, first annular link 4*a* is bonded to second annular link 4*b* by solder 15, best viewed in FIG. 11. Third annular link 4*c* is attached to fourth annular link 4*d* in like manner. The bonding between each of these two pairs of annular links insures that the rope chain will not unravel into its constituent elements. So that the chain will remain flexible, second annular link 4*b* is not bonded to adjacent third annular link 4*c*. Similarly, fourth annular link 4*d* is not attached to the adjacent first link of the next repetition.

Either of the two connecting means 9 described above, or any of the connecting means hereinafter described may be used to connect a rope chain segment 2 with the component 9 as they each operate on the same principle: They promotes the integration of the component with the links of a conventional rope chain by receiving onto the component the individual links of the rope chain in their ordinary sequence, relative position and orientation as is found on a conventional rope chain.

Figure 14:
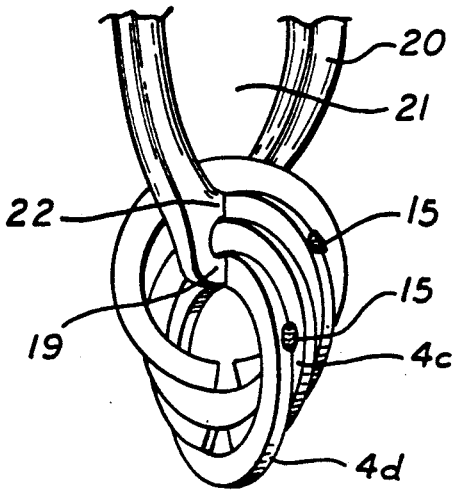

FIG. 12 depicts another embodiment of the invention, a one-half turn unfilled double helix 20. This embodiment 20 is termed "unfilled" because it is a substantial replica of a double helix having two helices, each spiraling around the other with an interstice therebetween. Unlike the embodiments described above, the space between the helices is not filled but instead comprises the spatial opening 21. The spatial opening 21 serves as an aperture for coupling with a rope chain segment 2. As shown in FIG. 13, the first annular link 4*a* in a repetition is inserted through the one-half turn unfilled double helix 20 via gap 5*a* so that the annular link 4*a* abuts against bridge 22, the portion between the spatial opening 21 and aperture 10. Annular link 4*a* is rotated until gap 5*a* is directed away from aperture 10. Annular link 4*b* is then coupled with annular link 4*a* and unfilled. double helix 20 via gap 5*b*. Gap 5*b* is placed so that it abuts bridge 22. Referring to FIG. 14, gap 5*c* of third annular link 4*c* is then threaded through first and second annular links 4*a* and 4*b* and unfilled double helix 20. As in the previous examples, gap 5*c* of annular link 4*c* is directed away from aperture 10. Finally, fourth annular link 4*d* is coupled with annular links 4*a*– 4*c* and unfilled double helix 20 via gap 5*d*. Gap 5*d* is brought to abut to lobe 19. This completes the first repetition. Solder 15 is applied in the manner previously described above.

Figure 15:
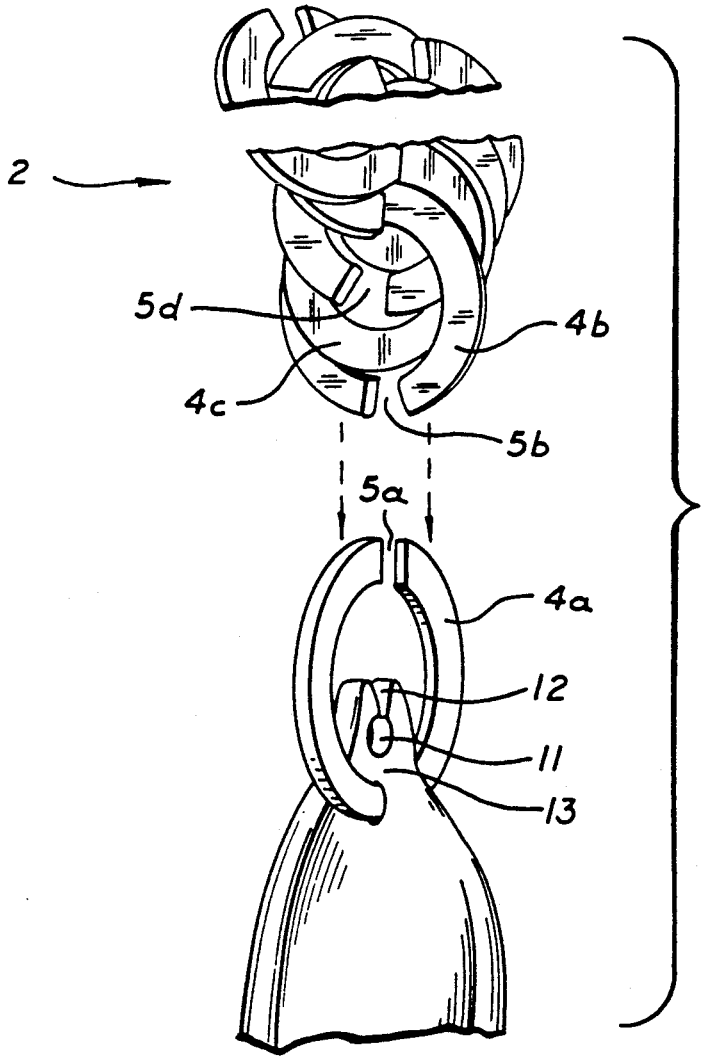
FIG. 15 illustrates a method of connecting the invention with the annular links of a rope chain whereby the rope chain is preformed before being received into the spiral component.

Heretofore we have described one manner of attaching rope chain links to the rope chain component 1 consisting of first attaching a first link to the component 1 and then sequentially weaving in a second, third and fourth link and etc. Another means of achieving this same result is now described as follows. For illustrative purposes, take the case of a four-link rope chain. Preform a length of rope chain according to known conventional methods by taking a first annular link 4*a* and interlinking to it a second annular link 4*b* and thereafter attaching to the evolving rope chain a third annular link 4*c* and a fourth annular link 4*d*. The process is repeated by linking another first annular link 4*a* after fourth annular link 4*d* to begin the next repetition and continues until the desired length of rope chain is obtained. At the extremity, the first annular link 4*a* is removed to expose second annular link 4*b* as the end link. As can be seen in FIG. 15, second annular link 4*b* has gap 5*b* displaced away from the length of rope chain segment 2. An annular link is then inserted into aperture 10 of component 1 with gap 5*a* displaced away from the component. This annular link comprises the first annular link 4*a* of a repetition. The length of rope chain with second annular link 4*b* as its first link is then brought to the component and the two parts are integrated by inserting gap 5*a* first through annular link 4*b* or gap 5*b*, through a portion of annular link 4*c* and then through gap 5*d*. Likewise, gap 5*b* of annular link 4*b* is brought through annular link 4*a* or gap 5*a*, through opening 12 and open aperture 11 until it comes to rest at nexus 13. A portion of annular link 4*c* is also brought through gap 5*a*, opening 12 until it sets within open aperture 11. Gap 5*d* is brought through gap 5*a* and sits adjacent to opening 12. By fitting the various links together in the above manner and soldering them as previous described, the outcome is the same as the process described earlier, that is, where a repetition of annular links 4 are mated initially to a component before subsequent repetitions are mated to the growing chain.

The component can be made in different lengths. FIGS. 16–17 depicts a third embodiment of the component. Here the component is a full turn filled double helix. FIG. 17 illustrates the individual component while FIG. 16 shows the component in a position of use. By lengthening the spiral component, additional savings of labor and material costs can be realized. However, the resulting bracelet or necklace will be less flexible because the actual rope chain segments will be proportionately lessened.

FIGS. 18 and 19 illustrate a full turn unfilled double helix structure. In FIG. 18, the connection means at the pictured lower end is comprised of two closed apertures while in FIG. 19, the connection means at the pictured lower end is comprised of an elongated aperture 14. In both cases, a four-link or six-link variety of rope chain may be used. If a six-link variety of rope chain is to be used, the spatial opening 21 is used to receive the first link of the six link repetition.

FIG. 20 depicts another embodiment of the component with connection means 9 for a six-link rope chain configuration.

The integration of a rope chain segment of the six link variety with the rope chain component adapted for the six link rope chain, is accomplished in like manner to the four-link counterpart. As taught by U.S. Pat. No. 4,651,517, in the six link configuration, the dimensions of each link must be modified to adjust for the additional two links to complete a repetition. When applied to the rope chain component, the six-link annular link must be altered to accommodate the additional length of the rope chain component required by the addition of a third aperture or its equivalent. The altered or "six-link" annular link 26 is depicted in FIG. 30.

The above-described manner of "sliding-in" a preformed segment of rope chain to mate with a component 1 and an annular link pre-positioned on the component 1, can be extended to the six-link variety and other varieties of rope chain. In the case of the six-link variety, this may be accomplished in one of two ways. In the first alternative, three annular links 26, comprising the first, second and third annular links of a six-link rope chain segment are first attached to and pre-positioned on the component 1, through third aperture 32, at nexus 13 and through second aperture 31, before the six-link rope chain segment (with the appropriate fourth annular link leading the way) is "slid" onto the component 1 for mating with the component and the three pre-positioned annular links. For the rope chain segment to "slide" into the component 1, the connecting means 9 at the extremity comprises opening 12. After the rope chain segment is "slid" into the rope chain component 1, the application of solder 15 to bond the annular links as described above will prevent the rope chain segment from unraveling. In a second and preferred alternative, a bifurcation 33 is placed between the first aperture 30 and the second aperture 31. The bifurcation 33 is illustrated in FIG. 20 and indicated by the dotted lines. In this way, only one annular link 26 need be prepositioned on the component 1, at third aperture 32, as the other annular links to be connected with the component can be "slid" through the opening 12 and the bifurcation 33 to be attached to the prepositioned annular link. Again, solder 15 is applied to the annular links as described previously to prevent the unraveling of the rope chain.

FIG. 21 depicts an embodiment of the component that contains filigreed feature 23. FIG. 22 depicts connection means comprised of an open elongated aperture 24. Depending upon the length of the aperture, it may accommodate two or more annular links. The first link is soldered to the component as shown at 15. The open elongated aperture 24 receives a plurality of annular links 4 of a rope chain segment 2 onto the component 6 in their ordinary sequence and orientation. Therefore the open elongated aperture 24 is preferably formed so that this would be possible. One manner of facilitating the acceptance of the annular links 4 within the elongated aperture in their ordinary sequence and angular orientation would be to form the elongated aperture 24 in a "twisting" manner so that the location where a first annular link rests will have a 22.5 degree angular differential relative to the location where the next annular is to rest. However, the same result may be obtained by forming the elongated aperture with a width that would provide enough space to tolerate the varying angular orientations. The use of the open elongated aperture 24 in this above-described manner is a quick means of connecting a rope chain segment 2 with the component. However, because the rope chain segment 2 is secured to the component 6 only by solder 15 and there is no other structural support, the connection means is not as strong as the other methods described herein.

FIG. 23 illustrates a sixth embodiment of the component where annular link members 25 are integrally formed on each end of the component. These annular link members 25 comprise the first links of a repetition. Additional links are then attached (and soldered where required) as taught in the prior art.

FIGS. 24 to 27 provide suggested dimensions for one aspect of the practice of this invention. It cannot be stressed too strongly that these dimensions are illustrative only and not limiting.

FIG. 24 depicts the conventional annular link. The outer diameter of the annular link $D_o$, i.e. the diameter from periphery to periphery, is approximately 4.08 mm. The inner diameter $D_1$ is approximately 2.55 mm. At the gap 5, the opening at the outer periphery is about 1 mm and narrows to 0.89 mm at the inner periphery. The cross-sectional width and thickness are 0.77 mm and 0.62 mm respectively.

Figure 27:
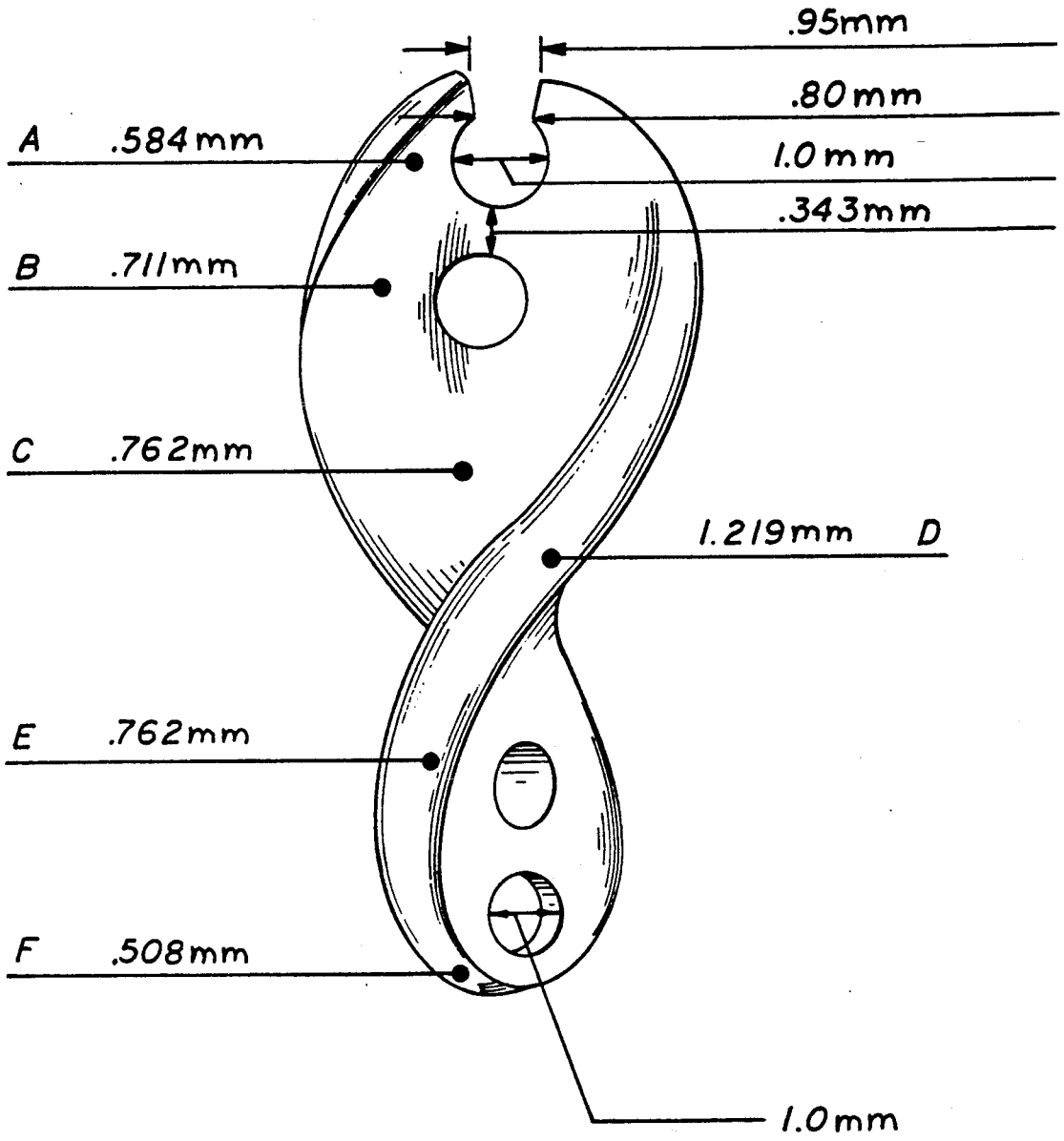
FIG. 27 depicts the one-half turn rope chain component with relevant dimensions.

Referring to FIG. 27, the suggested dimensions of the preferred embodiment are as follows: At the outer portion of the gap, the opening is about 0.95 mm. The gap is 0.8 mm at the point it abuts the open aperture 11. The open aperture 11 and aperture 10 are each 1 mm in diameter. The aperture 10 and open aperture 11 are spaced approximately 0.34 mm from each other. At the other end, the two apertures 10, 10 each have diameters of about 1 mm. The aperture 10 closest to the end is about 0.3 mm removed therefrom in the described embodiment. There may be some variance in this distance. A distance greater than 0.3 mm would provide more structural support for the associated annular link contained therein but may result in less flexibility between the rope chain segment and and rope chain component.

The thickness of the spiral component at various points as indicated in FIG. 27, is noted in the following table:

| Location | Thickness (mm) |
|---|---|
| A | .584 |
| B | .711 |
| C | .762 |
| D | 1.219 |
| E | .762 |
| F | .508 |

From edge to edge, the spiral component is about 5.09 mm wide while from end to end it is approximately 10 mm in length.

Referring to FIG. 26 with regard to the rope chain itself, the width of the double helix is 4 mm while the diameter of each helicoidal strand 7,8 is approximately 2 mm. The elements of FIG. 26 are not shown to scale in order to more clearly illustrate the relative dimensions thereof.

Where the connecting means comprise three or more apertures or the equivalent of three or more apertures on a component, the annular link must be modified and elongated to accommodate the length of component that the annular link must encompass. FIG. 30 depicts an elongated annular link 26 that is used wherein the connection means comprises or is equivalent to three apertures.

FIGS. 28 and 29 illustrates the annular link and its schematic equivalent. Schematic equivalent 28 represents an annular link wherein the gap 5 is directed in the indicated direction. Schematic equivalent 29 represents an annular link wherein the gap 5 is directed in the opposite direction. The schematized gap 5' in the equivalents depict the direction which the actual gap 5 takes. FIG. 31 schematically depicts the orientation of the annular links with respect to each other and with respect to the components 6*a* and 6*b* which are connected by the rope chain segment. The schematic representation also indicates the connection of the individual links by solder 15.

Figure 32:
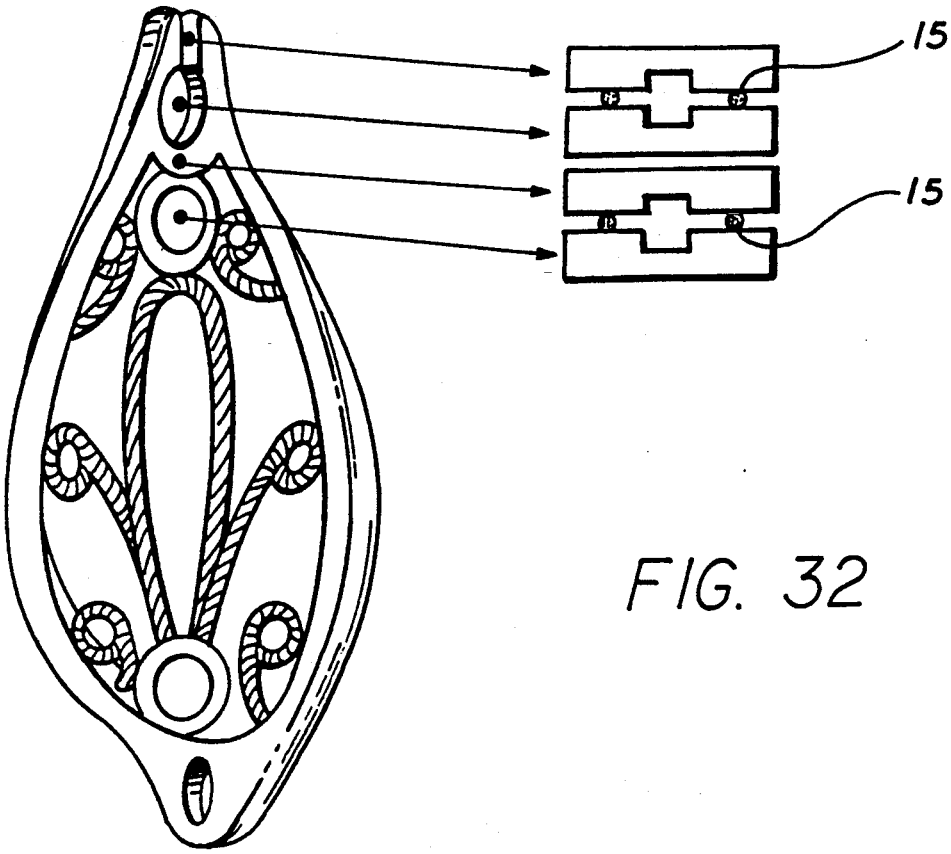
FIG. 32 is an illustrative schematic representation of the annular links as they are oriented with respect to the component and to each other in the practice of this invention in the four-link repetition variety where the component is filigreed.
Figure 33:
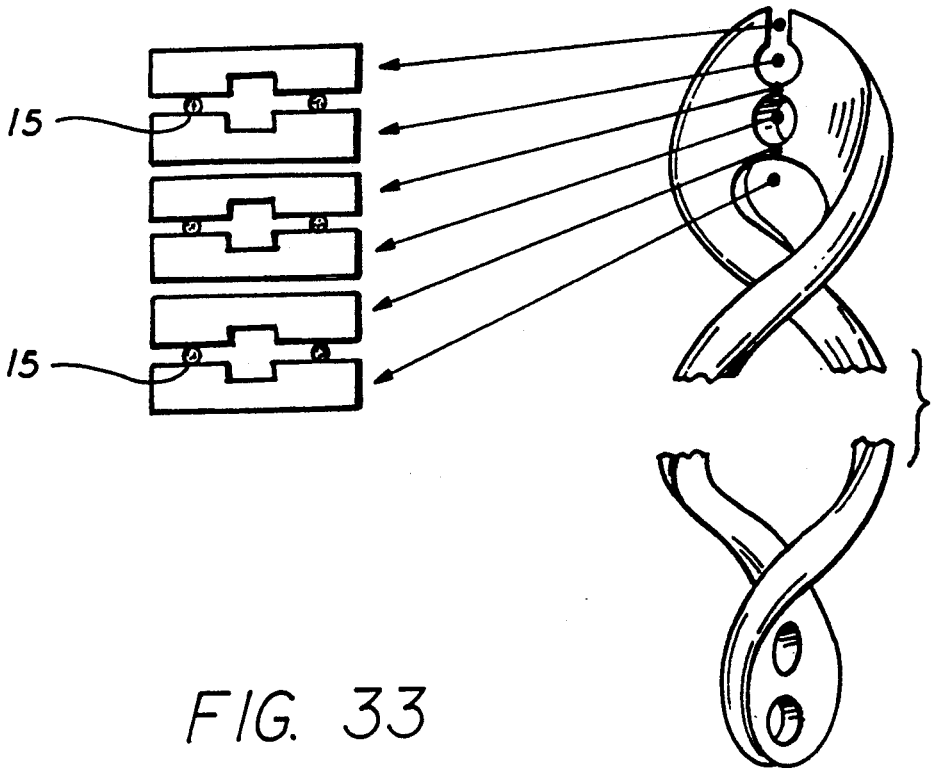
FIG. 33 is an illustrative schematic representation of the annular links as they are orientated with respect to a double helix component and to each other in the practice of this invention in the six-link repetition variety.

FIGS. 32, 33 and 34 schematically depicts the integration of the annular links 4 with the filigreed component, the six-link double helix spiral component and the six-link "filled" spiral component respectively, so that those skilled in the art will appreciate the preferred orientation of gaps 5 in the links 4. Pairs of links 4 are soldered, as shown at 15.

The drawings and the foregoing description are not intended to represent the only form of the invention in regard to the details of its construction and manner of operation. In fact, this apparatus and method can be adapted to a great many different situations. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. Jewelry comprising annular links of the type used in forming a jewelry rope chain and a component for coupling with said annular links, said component comprising a body having connecting means at one edge thereof for receiving at least one of said annular links, said at least one of said annular links and at least three neighboring links all being located in a sequence and position corresponding to and maintaining the continuity of the sequence and position which said annular links take when formed into said jewelry rope chain.

2. Jewelry as claimed in claim 1 wherein said connecting means is comprised of two apertures formed on said body.

3. Jewelry as claimed in claim 2 wherein said two apertures is comprised of a first and a second aperture, said first aperture located nearer an edge of said body than said second aperture and said first aperture having an opening disposed adjacent thereto at said edge.

4. Jewelry as claimed in claim 2 wherein said two apertures each have an axis, said two axes angularly displaced from each other by approximately 45 degree.

5. Jewelry as claimed in claim 1 wherein said connecting means is comprised of an elongated aperture formed on said body.

6. Jewelry as claimed in claim 1 wherein said body has a first edge and a second edge wherein a first connecting means is formed near said first edge and a second connecting means is formed near said second edge.

7. Jewelry as claimed in claim 6 wherein said first connecting means is comprised of two apertures and said second connecting means is comprised of an elongated aperture.

8. Jewelry as claimed in claim 6 wherein said connecting means comprise a notch located on said first and second edges whereon a ring of said rope chain abuts.

9. Jewelry as claimed in claim 1 wherein said body is substantially helicoidal in shape.

10. Jewelry as claimed in claim 1 wherein said body has a spatial opening formed thereon.

11. Jewelry as claimed in claim 1 wherein said body has a first edge and a second edge, a first aperture formed near said first edge and a second aperture formed near said second edge, and a spatial opening formed on said body between said first aperture and said second aperture, said connecting means comprised of said spatial opening and said first aperture accepting said annular links of said rope chain.

12. Jewelry as claimed in claim 1 wherein said body is shaped like a double helix, comprising two helices spiraling around each other.

13. Jewelry as claimed in claim 1 wherein said body has filigreed elements formed thereon.

14. Jewelry as claimed in claim 1 wherein said body has a precious stone set thereon.

15. Jewelry as claimed in claim 1 wherein said connecting means comprises three apertures formed on said body.

16. Jewelry as claimed in claim 1 wherein said connecting means is comprised of at least one aperture and a scallop formed adjacent to said aperture.

17. Jewelry as claimed in claim 1 wherein said connecting means is comprised of an aperture formed near an edge of said body, said aperture receiving therewithin a first annular link, a second annular link having a gap, said gap abutting said body between said aperture and said edge.

18. Jewelry comprising annular links of the type used in forming a jewelry rope chain and a component for coupling with said annular links, said component comprising a unitary body having a substantially spiral shape, said body having a first end with a first aperture and a second aperture formed thereon, said first aperture receiving therewithin a first annular link and said second aperture receiving threwithin a third annular link, said annular links received into associated said apertures in a position and orientation as each annular link is substantially comprised on said jewelry rope chain.

19. Jewelry as claimed in claim 18 wherein a second annular link is disposed between said first annular link and said third annular link.

20. A method of making jewelry comprising the steps of:

making a component for coupling with annular links of a jewelry rope chain, said component comprising a unitary body, said body having an end with a first aperture and a second aperture formed thereon, said first aperture located nearer to said end than said second aperture;

inserting a first annular link having a gap therein into said second aperture, said gap thereafter being oriented away from said body;

positioning a second annular link having a gap therein by threading its gap through said first annular link so its gap rests adjacent to said component between said first aperture and said second aperture;

inserting a third annular link having a gap therein into said first aperture by first threading its gap through said second annular link and said first annular link and then through said first aperture and rotating said third annular link until said its gap is oriented away from said body;

positioning a fourth annular link having a gap therein by threading its gap through said third annular link, said second annular link and said first annular link so that its gap abuts near said end of said body.

21. A method of making jewelry as claimed in claim 20 further comprising a step of soldering said first annular link to said second annular and said third annular link to said fourth annular link.

22. A method of making jewelry comprising the steps of:

making a component for coupling with annular links of a jewelry rope chain, said component comprising a body, said body having a first end with a first aperture and a second aperture formed thereon, said first aperture located nearer to said end than said second aperture;

inserting into said second aperture a first annular link having a gap therein, said gap oriented away from said body;

fashioning a length of conventional four-link rope chain segment with a plurality of annular links, said length of rope chain segment fashioned so that an end of said segment has a second annular link exposed, said second annular link having a gap therein, said gap of said second annular link being oriented away from said rope chain segment and toward said end;

integrating said rope chain segment with said first annular link and said body by bringing the gap of said second annular link into an abutting relationship with a portion of said component located between said first and second aperture and by simultaneously bringing said gap of said first annular link through at least one annular link of said rope chain segment.

23. A method of making jewelry as claimed in claim 22 further comprising the step of bifurcating said first end so that said first aperture has an opening adjacent thereto and wherein said length of rope chain segment comprises a third annular link with a gap therein, said third annular link located adjacent to said second annular link, and a fourth annular link with a gap therein, said fourth annular link located adjacent to said third annular link, so that in said integrating step, said third annular link is brought through said opening and into said first aperture and said gap of said fourth annular link is brought to confront said opening.

24. A method of making jewelry as claimed in claim 22 further comprising the step of soldering said first and said second annular links together and said third and said fourth annular links together.

25. A method of making jewelry as claimed in claim 22 wherein during said making step, said first annular link of said inserting step is integrally formed on said component.

26. A method of making jewelry as claimed in claim 22 wherein during said making step, the component is made in an elongated shape.

27. A method of making jewelry as claimed in claim 22 wherein during said making step, the component is made in a substantially spiral shape.

28. A method of making jewelry as claimed in claim 22 wherein said component is made with filigreed elements.

29. A method of making jewelry comprising the steps of:

making a component for coupling with annular links of a jewelry rope chain, said component comprising a body, said body having a first end with a first aperture, a second aperture and a third aperture formed thereon, said first aperture located nearer to said end than said second aperture and said third aperture;

inserting into said third aperture a first annular link having a gap therein, said gap oriented away from said body;

positioning a second annular link having a gap therein so that its gap abuts between said third and second apertures;

inserting into said third aperture a third annular link having a gap therein so that said gap is oriented away from said body;

fashioning a length of conventional six-link rope chain segment with a plurality of annular links, said length of rope chain segment fashioned so that an end of said segment has a fourth annular link exposed, said fourth annular link having a gap therein, said gap of said fourth annular link being oriented away from said rope chain segment and toward said end;

integrating said rope chain segment with said first, second and third annular links and said body by bringing the gap of said fourth annular link into an abutting relationship with a portion of said component located between said first and second apertures and by simultaneously bringing said gap of said third annular link through at least one annular link of said rope chain segment.

30. A method of making jewelry as claimed in claim 29 further comprising the step of soldering said first and said second annular links together and said third and said fourth annular links together.

31. A method of making jewelry as claimed in claim 29 further comprising the step of making said body with filigreed elements formed thereon.

32. A method of making jewelry as claimed in claim 29 further comprising the step of making said body with a precious stone set thereon.

33. A method of making jewelry comprising the steps of:

making a component for coupling with annular links of a jewelry rope chain, said component comprising a body, said body having a first end with a first aperture, a second aperture and a third aperture formed thereon, said first aperture located nearer to said end than said second aperture, and a bifurcation disposed between said first aperture and said second aperture;

inserting into said third aperture a first annular link having a gap therein, said gap oriented away from said body;

fashioning a length of conventional six-link rope chain segment with a plurality of annular links, said length of rope chain segment fashioned so that an end of said segment has a second annular link exposed, said second annular link having a gap therein, said gap of said second annular link being oriented away from said rope chain segment and toward said end, said rope chain segment further having a third annular link adjacent to said second annular, said third annular link having a gap therein oriented toward said rope chain segment and away from said body;

integrating said rope chain segment with said first annular link and said body by bringing the gap of said second annular link into an abutting relationship with a portion of said component located between said second and third apertures, by bringing said third annular link through said bifurcation and into said second aperture, and by simultaneously bringing said gap of said first annular link through at least one annular link of said rope chain segment.

34. A method of making jewelry as claimed in claim 33 further comprising the step of soldering said first and said second annular links together and said third annular link together with a fourth annular link.

35. A method of making jewelry as claimed in claim 33 wherein in said making step, the component is made with an elongated aperture in place of said first and second apertures and said birfurcation therebetween.

36. A method of making jewelry as claimed in claim 33 further comprising the step of making said body with filigreed elements formed thereon.

37. A method of making jewelry as claimed in claim 33 further comprising the step of making said body with a precious stone set thereon.

38. A method of making jewelry as claimed in claim 33 further comprising the step of soldering said first, second and third annular link together with a fourth annular link and soldering every four subsequent annular links together on said jewelry rope chain.

39. Jewelry comprising annular links of the type used in forming a jewelry rope chain and a component for coupling with said annular links, said component comprising a unitary body, said body having an end with an aperture formed thereon, said aperture receiving therewithin a plurality of annular links in respective positions as said annular links are substantially comprised on said jewelry rope chain.

40. Jewelry as claimed in claim 39 wherein said body is substantially spiral in shape.

41. Jewelry comprising annular links of the type used in forming a jewelry rope chain and a component for coupling with said annular links, said component having a substantially spiral shape, said component having an edge an aperture formed near said edge, said aperture receiving therewithin a first annular link, a second annular link having a gap, said gap abutting said component between said aperture and said edge, said first and said second annular links having a position with respect to each other and to a third annular link immediately adjacent to said second annular link corresponding to the position which said annular links take when formed into said jewelry rope chain.

42. Jewelry comprising annular links of the type used in forming a jewelry rope chain and a component for coupling with said annular links, said component comprising a body having connecting means at one edge thereof for receiving a plurality of said annular links in a sequence and position corresponding to and maintaining the continuity of the sequence and position which said annular links take when formed into said jewelry rope chain.

* * * * *